US005827087A

United States Patent [19]

Yamasaki

[11] Patent Number: 5,827,087

[45] Date of Patent: Oct. 27, 1998

[54] ELECTRICAL CONNECTOR FOR CABLES OF DIFFERENT GAUGES

[75] Inventor: Shuji Yamasaki, Tokyo, Japan

[73] Assignee: NEC Corporation, Tokyo, Japan

[21] Appl. No.: 808,953

[22] Filed: Feb. 19, 1997

[30] Foreign Application Priority Data

Feb. 21, 1996 [JP] Japan ..... 8-033889

[51] Int. Cl.[6] ..... H01R 4/24

[52] U.S. Cl. ..... 439/395; 439/398

[58] Field of Search ..... 439/395, 398, 439/443, 408, 396, 400, 403, 404

[56] References Cited

U.S. PATENT DOCUMENTS

| | | | |
|---|---|---|---|
| 4,116,522 | 9/1978 | Reynolds | 439/408 |
| 4,548,459 | 10/1985 | Mosser, III | 439/395 |
| 4,840,579 | 6/1989 | Heng et al. | 439/395 |
| 4,964,811 | 10/1990 | Hayes, Sr. et al. | 439/398 |

FOREIGN PATENT DOCUMENTS

| | | | |
|---|---|---|---|
| 3541371 | 5/1987 | Germany | 439/395 |
| 59-110974 | 7/1984 | Japan . | |
| 61-153969 | 9/1986 | Japan . | |
| 61-224277 | 10/1986 | Japan . | |
| 61-189569 | 11/1986 | Japan . | |
| 62-262378 | 11/1987 | Japan . | |
| 2-78164 | 3/1990 | Japan . | |
| 2-103878 | 4/1990 | Japan . | |
| 3-4461 | 1/1991 | Japan . | |
| 404179072 | 6/1992 | Japan | 439/395 |

*Primary Examiner*—Hien Vu
*Assistant Examiner*—Tho D. TA
*Attorney, Agent, or Firm*—Sughrue, Mion, Zinn, Macpeak & Seas, PLLC

[57] ABSTRACT

A cable connector in the form of a single flat metal plate and capable of stably connecting a cable consisting of a core and a covering is disclosed. The cable connector connects a cable stably over a long period of time without regard to the diameter of the cable by using the same jig and the same connecting method.

6 Claims, 7 Drawing Sheets

ELECTRICAL CONNECTOR FOR CABLES OF DIFFERENT GAUGES

BACKGROUND OF THE INVENTION

The present invention relates to a cable connector in the form of a flat metal plate for stably connecting a cable consisting of a core and an insulating covering.

A cable connector of the kind described is extensively used today and formed with a notch consisting of an inlet portion, a slit-like cutting portion, and a contact portion. The inlet portion extends from one edge of the cable connector or metal plate and guides a cable into the notch. The cutting portion contiguous with the inlet portion cuts the covering of the cable when the cable is pressed deeper into the notch. The contact portion contiguous with the cutting portion nips the core of the cable when the cable is pressed thereinto, while electrically contacting the core. The problem with this kind of cable connector is that it is not applicable to cables other than one whose diameter matches the width of the cutting portion.

Japanese Patent Laid-Open Publication No. 61-224277, for example, discloses a cable connector capable of eliminating the above problem. However, the cable connector taught in this document cannot connect a cable sufficiently stably although its cutting portion or slit can nip the core of the cable without regard to the diameter of the core.

Other prior art cable connectors are taught in Japanese Utility Model Laid-Open Publication Nos. 61-153969, 59-110974 and 61-189569, Japanese Patent Laid-Open Publication Nos. 2-78164, 62-262378 and 2-103878, and Japanese Utility Model Laid-Open Publication No. 3-4461.

SUMMARY OF THE INVENTION

It is therefore an object of the present invention to provide a cable connector capable of connecting a cable stably over a long period of time without regard to the diameter of the core of the cable.

It is another object of the present invention to provide a cable connector capable of connecting a cable stably over a long period of time with the same jig and the same method.

A cable connector of the present invention is implemented as a single flat metal plate. A notch is formed in the metal plate and made up of an inlet portion, a slit-like cutting portion, and a contact portion. The inlet portion extends from one edge of the metal plate, and is open at the one edge widely enough to receive a cable consisting of a core and a covering, and sequentially reduced in width for guiding the cable. The cutting portion extends from the inlet portion in one direction and has a width for cutting the covering up to the core. The contact portion extends from the cutting portion to terminate at a generally U-shaped slit portion, for nipping and electrically contacting the core at both edges of the slit. A pair of parallel elongate holes are also formed in the metal plate at opposite sides of the slit of the contact portion, and extend along the slit. A pair of lugs each protrudes from one of opposite edges of the respective elongate hole toward the other edge. When the cable is pushed into the notch, beam portions each intervening between the contact portion and the respective elongate hole deforms to thereby cause the respective lug and respective edge facing each other abut against each other.

BRIEF DESCRIPTION OF THE DRAWINGS

The above and other objects, features and advantages of the present invention will become apparent from the following detailed description taken with the accompanying drawings in which.

In the drawings, identical reference numerals denote identical structural elements.

DESCRIPTION OF THE PREFERRED EMBODIMENT

Figure 1A:
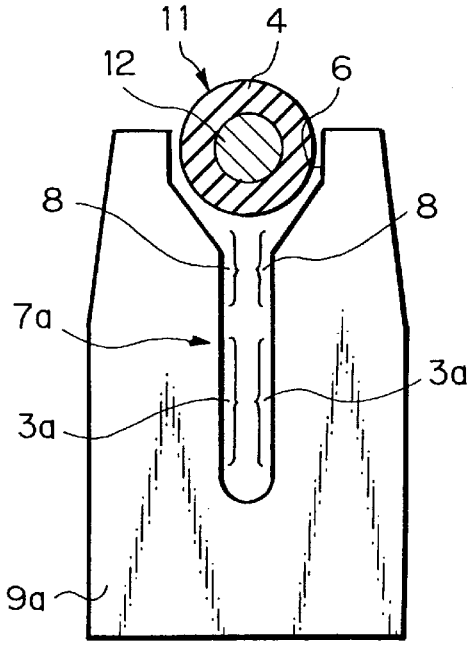
Fig. 1A PRIOR ART
FIGS. 1A and 1B are plan views showing a conventional cable connector.
Figure 1B:
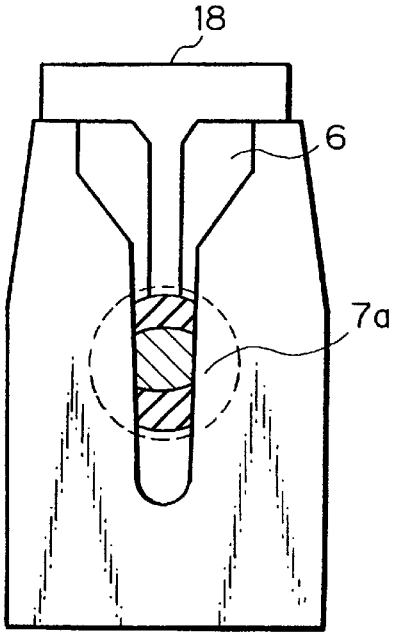
Fig. 1B PRIOR ART

To better understand the present invention, brief reference will be made to a conventional cable connector, shown in FIGS. 1A and 1B. As shown in FIG. 1A, the cable connector is implemented as a metal plate 9*a* formed with a notch, as illustrated. The notch consists of an inlet portion 6 open at one edge of the metal plate 9*a*, a slit-like cutting portion 8 contiguous with the inlet portion 6, and a contact portion 3*a* contiguous with the cutting portion 8. A cable 11 to be connected by the connector is made up of a core 12 and a covering 4. The inlet portion 6 is widely open at the above edge of the metal plate 9*a* in order to receive and guide the cable 11, and sequentially decreases in width toward the cutting portion 8. The cutting portion 8 is so dimensioned as to cut into the covering 4 of the cable 11 as far as the core 12. The contact portion 3*a* terminates at a generally U-shaped slit 7*a*. As shown in FIG. 1B, when the cable 11 is pushed into the slit 7*a* by a presser plate 18, the opposite edges of the slit 7*a* nip the core 12 of the cable 11 and electrically contact the core 12.

However, it is difficult to hold the cable 11 in stable contact with the conventional cable connector over a long period of time. Specifically, the cable connector is not applicable to cables other than the cable 11 whose core 12 has a diameter matching the width of the slit 7*a*. A cable having a core whose diameter is smaller than the width of the slit 7*a* will slip out of the connector. On the other hand, a cable with a core whose diameter is greater than the width of the slit 7*a* will exert an excessive stress on the two beam members of the connector delimiting the slit 7*a*, reducing the service life of the connector. In this manner, no margin is available with the conventional cable connector as to the diameter of the core 12.

Figures 2A, 2B:
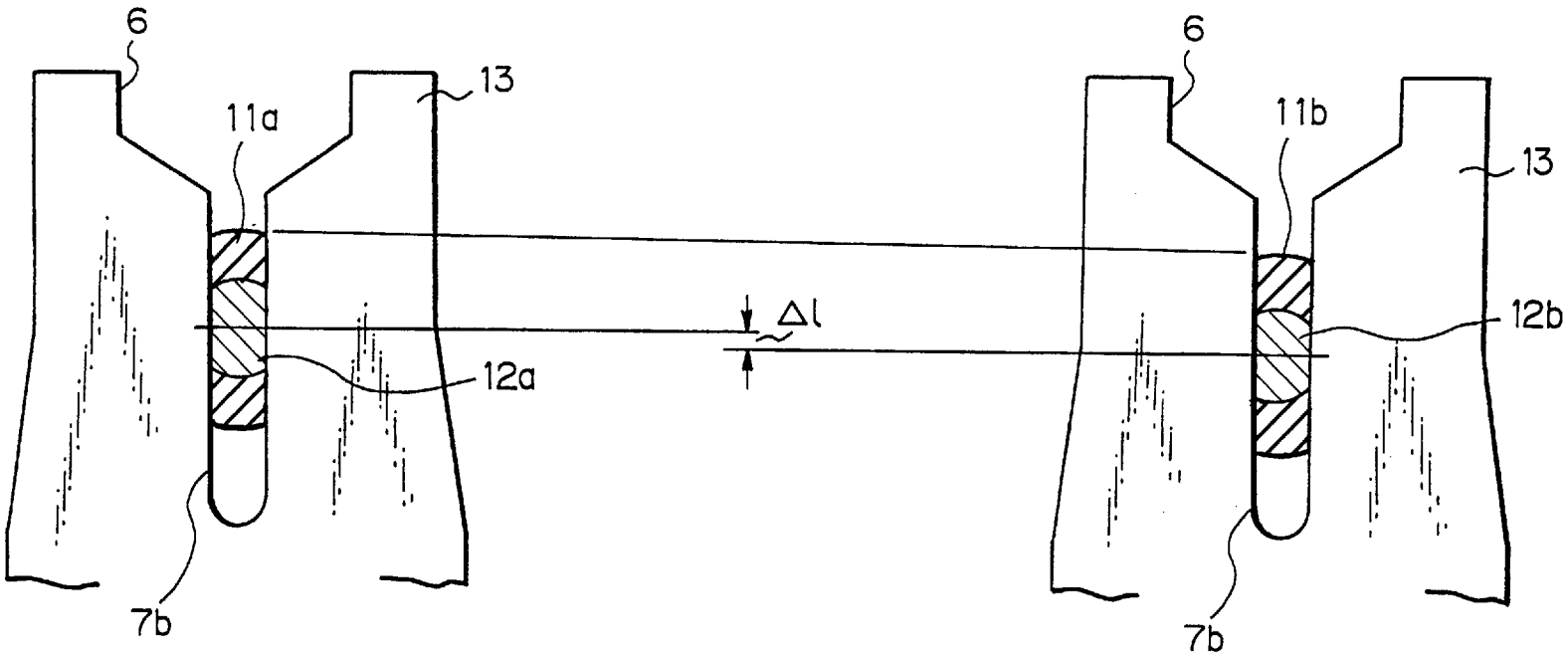
Fig. 2B PRIOR ART
Fig. 2A PRIOR ART
FIGS. 2A and 2B are plan views showing another conventional cable connector.

FIGS. 2A and 2B show another conventional cable connector configured to solve the above problem and taught in Japanese Patent Laid-Open Publication No. 61-224277 mentioned earlier. FIG. 2A shows the connector together with a cable 11*a* whose core 12*a* has a diameter matching the width of a slit 7*b*. FIG. 2B shows the connector together with a cable 11*b* whose core 12*b* has a diameter greater than the width of the slit 7*b*. As shown in FIG. 2B, the cable 11*b* with the core 12*b* is pushed deeper into the slit 7*b* than the cable

11*a* with the core 12*a* by a distance Δl. In this condition, the edges of the slit 7*b* nip the cable 11*b* with a stress maintained below the elastic limit of opposite resilient portions 13 delimiting the slit 7*b*. This, coupled with the fact that the contours of the cables 11*a* and 11*b* are the same in position as each other, as viewed from the top of the inlet portion 6, allows a single presser plate or jig to be used with both the cables 11*a* and 11*b*.

The cable shown in FIGS. 2A and 2B have some issues yet to be solved, as follows. Assume a cable having a stranded core, i.e., bundle of conductors. Then, when the cable is pushed into the slit 7*b*, the conductors break up and bring about defective contact due to short pressure. Although the cable 11*b* with the core 12*b* can be nipped by the pressure below the elastic limit of the resilient portions 13, it causes the ends of the portions 13 joining each other to plastically deform due to fatigue and creep ascribable to aging. As a result, the resilient portions 13 lose their nipping force and cause defective contact to occur. In addition, a cable with a core whose diameter is smaller than the width of the slit 7*b* cannot be firmly retained in the slit 7*b* and is apt to slip out of the slit 7*b* due to an unexpected impact or vibration.

Figure 3:
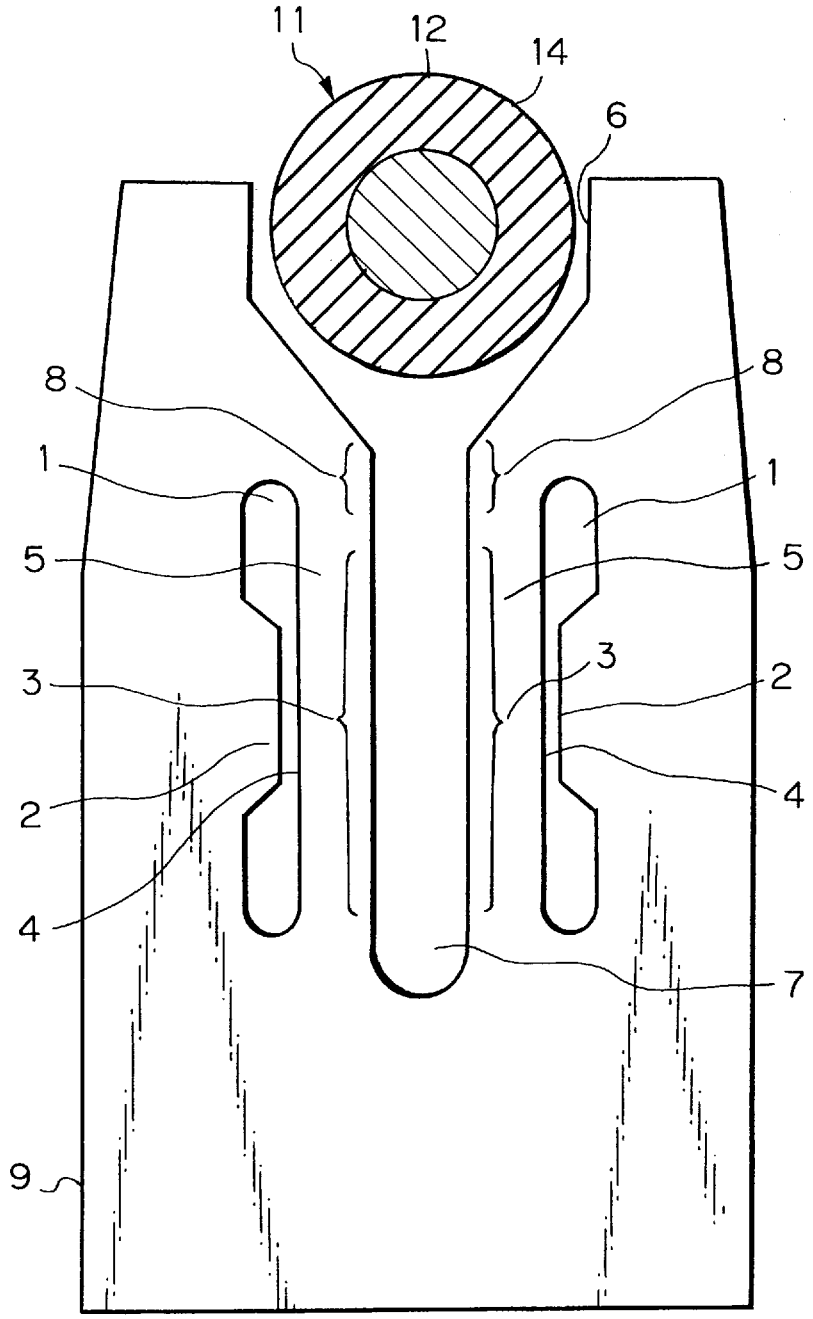
FIG. 3 is a plan view showing a cable connector embodying the present invention.

Referring to FIG. 3, a cable connector embodying the present invention will be described. As shown, the cable connector is implemented as a single flat metal plate 9. A notch consisting of an inlet portion 6, a cutting portion 8, and a contact portion 3 terminating at a generally U-shaped slit 7 is formed in the metal plate 9 in the same manner as in the prior art configuration. The notch may be formed in the metal plate 9 by pressing, etching or similar conventional technology.

In the illustrative embodiment, a pair of elongated holes 1 are additionally formed in the metal plate 9 at opposite sides of the slit 7. The elongated holes 1 extend along the slit 7 substantially in parallel with each other. A lug 2 protrudes from the edge of each hole 1 remote from the slit 7 toward the edge close to the slit 7 at substantially the intermediate between the opposite ends of the hole 1. When the edges of the slit 7 are pushed outward away from each other by the core 12 of the cable 11, beam portions 5 intervening between the contact portion 3 and the holes 1 deform. As a result, the inner edge 4 of each hole 1 is brought into contact with the respective lug 2 facing it, as will be described specifically later.

Figure 4:
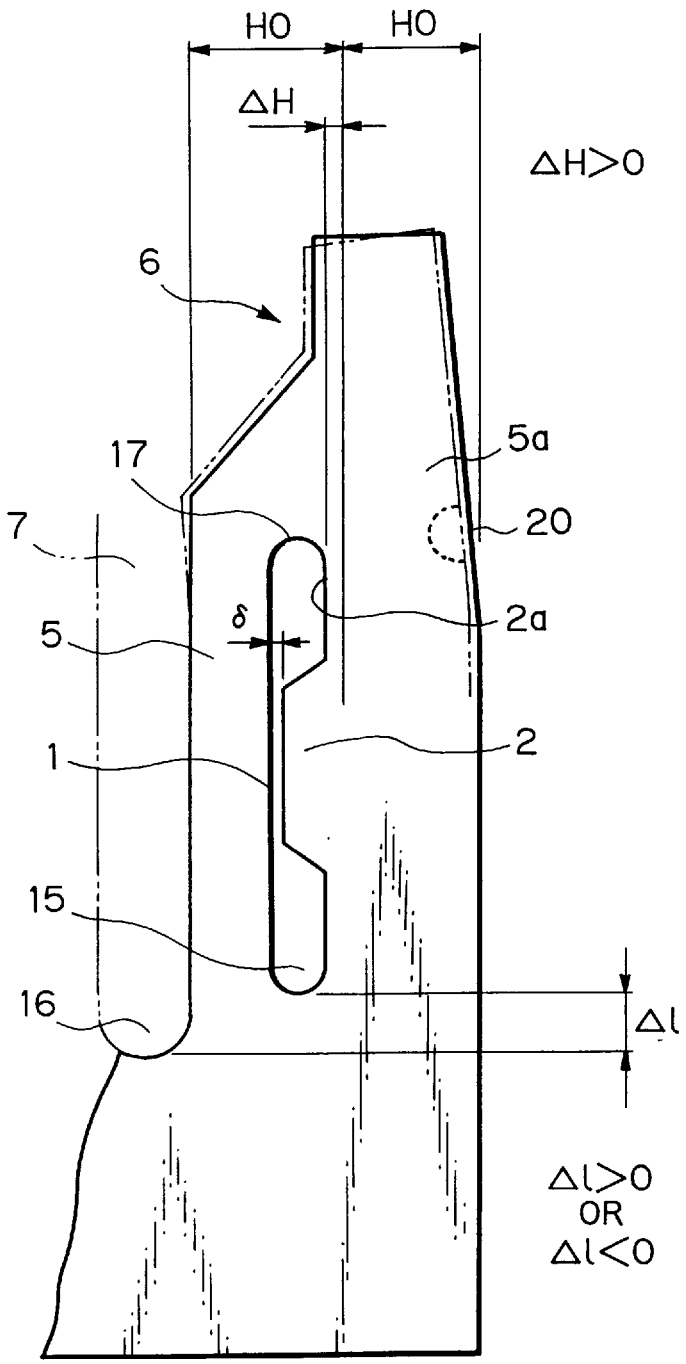
FIG. 4 is a fragmentary enlarged view showing one half of the cable connector shown in FIG. 3.

FIG. 4 is an enlarged view showing one half of the cable connector of FIG. 3. As shown, considering the two holes 1 with respect to the center of the slit 7, they have the same length between the center and the end. However, one end 15 of each elongated hole 1 adjoining the end 16 of the slit 7 is located at a distance, as measured from the center of the slit 1, greater than or smaller than the distance of the end 16 of the slit 7. The hole 1 has a width (except for the lug 2) smaller than the thickness of the beam portion 5. This is to provide the part of the beam portion 5 adjoining the other beam portion 5 with a greater section modulus than the other part of the portion 5, so that the stress to act on the above part of the portion 5 is reduced when the portion 5 deforms.

The other end 17 of the hole 1 which determines the length of the beam portion 5 is determined by an amount of deformation δ particular to the beam portion 5 and not causing the portion 5 to fatigue within the elastic limit. Therefore, whether the distance Δl between the end 15 of the hole 1 and the end 16 of the slit 7 is greater than zero or whether it is smaller than zero is determined by the shape or the thickness of the beam portion 5. The amount of deformation δ which the beam portion 5 undergoes when pressed by the core 12 is selected within the elastic limit, e.g., selected to be between 0.01 mm and 0.1 mm. Preferably, the width of the slit 7 is selected to be slightly smaller at the position above the lug 2 than at the position below the lug 2, so that the cable 11 pushed into the slit 7 is prevented from from falling.

The end 15 of the hole 1, like the end 16 of the slit 7, should preferably be shaped in the form of letter U in order to prevent the stress from concentrating. Also, the lug 2 of the hole 1 should preferably protrude from the edge 2*a* where the contact portion 3 is absent. This edge from which the lug 2 protrudes is closer to the slit 7 than the center of one half of the metal plate 9 by a distance ΔH.

Further, a rear portion 5*a* located at the rear of the hole 1 has a width H0+ΔH slightly greater than H0 which is the width of the side adjacent to the inlet portion 6. The rear portion 5*a* has its width sequentially reduced toward the upper end, as viewed in FIG. 4, so as to have a smaller section modulus than the portion adjoining the slit 7. In this configuration, assume that the lug 2 abuts against the inner edge of the hole 1 and fails to fully absorb the deformation of the beam portion 5. Then, a rotational bending moment acts on the end of the rear portion 5*a* and causes the portion 5*a* to deform, as indicated by a dash-and-dots line in FIG. 4. As a result, the rear portion 5*a* absorbs the part of the deformation which the lug 2 fails to absorb. In addition, such a deformation of the rear portion 5*a* reduces the width of the part of the slit 7 adjoining the inlet portion 6, thereby preventing the cable 11 from slipping out of the slit 7. To further enhance this effect, a circular notch 20 may be formed in the rear surface of the rear portion 5*a* at a position facing the end of the beam portion 5.

Figure 5C:
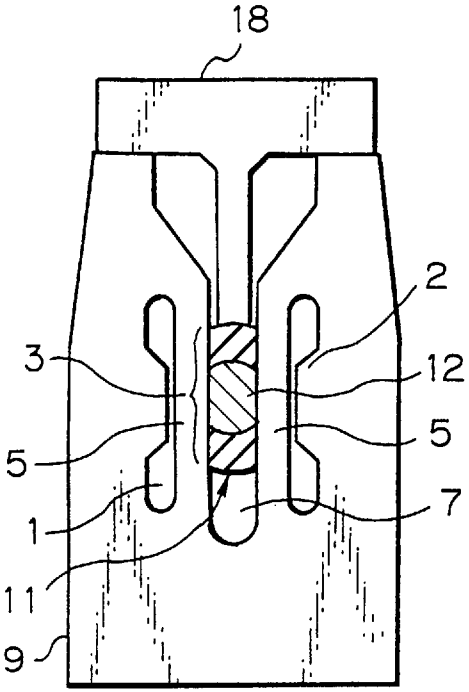
FIGS. 5A–5C are plan views showing how a cable having a relatively small diameter is connected by the embodiment.
Figure 5B:
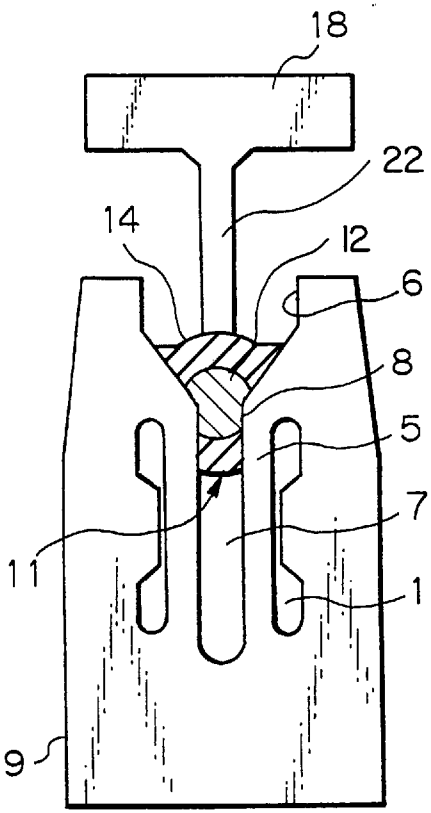
Figure 5A:
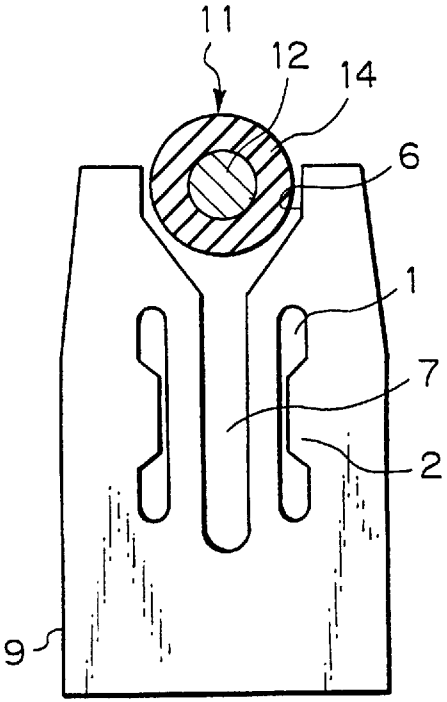

FIGS. 5A–5C demonstrate how a cable having a relatively small diameter is connected to the cable connector of the illustrative embodiment. First, as shown in FIG. 5A, the cable 11 including a single core having a diameter of 0.4 mm is introduced into the inlet portion 6. Then, as shown in FIG. 5B, a presser plate 18 having a pressing portion 22 pushes the cable 11 deeper into the inlet portion 6, causing the part of the slit 7 adjoining the inlet portion 7 to slightly open. At the same time, the cutting portion 8 cuts the covering 14 of the cable 11. As a result, the slit 7 is restored to its original width. As shown in FIG. 5C, the presser plate 18 further pushes the cable 11 until it abuts against the end of the metal plate 9. In this condition, the core 12 of the cable 11 is received in the contact portion 3 and held at a position aligning with the intermediate portions of the holes 1, as shown in FIG. 5C. The beam portions 5 moved away from each other by the cable 11 so that each abuts against the respective lug 2 at its edge facing the lug 2. Consequently, each beam portion 5 bends convexly toward the slit 7. This generates the same elastic stress in both ends of each beam portion 5. The resulting elastic repulsion allows the contact portion 3 of the slit 7 to surely nip and connect to the core 12.

Figure 6:
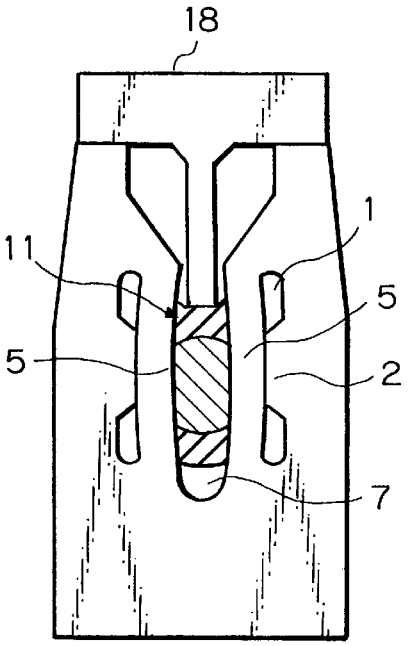
FIG. 6 is a plan view showing a cable having a relatively great diameter and connected by the embodiment.

FIG. 6 shows a cable having a relatively great diameter connected to the cable connector of the illustrative embodiment. Let the diameter of the core included in the cable be 0.05 mm slightly greater than the diameter of the cable shown in FIGS. 5A–5C. Again, the presser plate 18 is pushed into the slit 7 via the inlet portion 6 until it abuts against the end or shoulder of the cable connector. As a result, the cable 11 is held at a position 0.05 mm below the position of the cable 11 shown in FIG. 5C. In this condition, each beam portion 5 abutting against the associated lug 2 deforms to such a degree that it bulges convexly toward the outside. The beam portions 5 therefore retain the cable 11 at the above position and nip it with a force corresponding to the bending stress of the portions 5. This insures accurate electrical connection over a long period of time.

The illustrative embodiment is capable of connecting even a cable whose core has a relatively great diameter. This is because when the lug 2 abutting against the inner edge of the hole 1 fails to fully absorb the deformation of the beam portion 5, the rear portion 5*a* absorbs the part of the deformation which the lug 2 fails to absorb, as stated with reference to FIG. 4.

Figure 7:
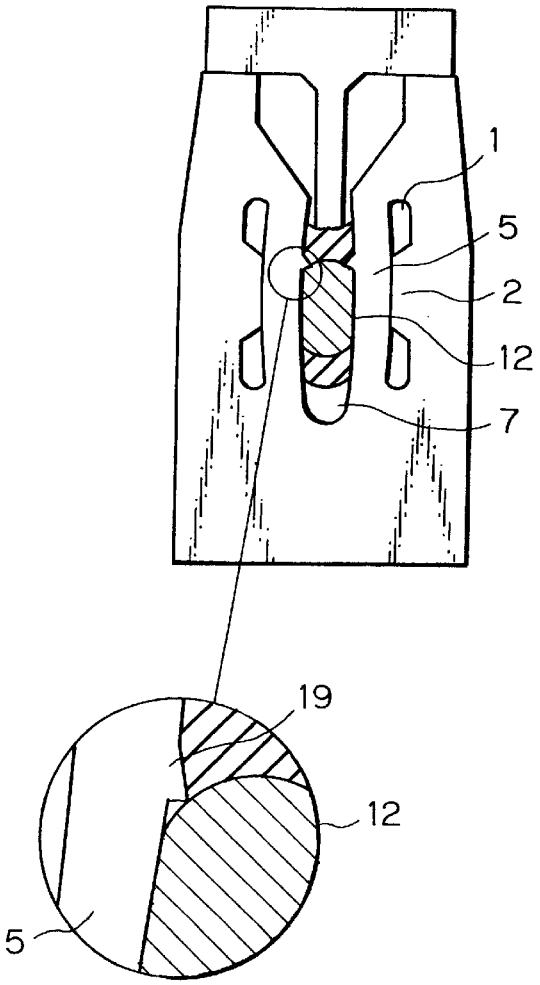
FIG. 7 is a plan view showing a modification of the embodiment.

A modification of the above embodiment will be described with reference to FIG. 7. As shown, a stop 19 protrudes from the inner edge of each beam portion 5 at the upper portion of the slit 7 facing the lug 2. Such stops 19 prevent the cable from slipping out of the slit 7 after the connection. The upper end of each stop 19 is inclined downward in order to facilitate the entry of the cable, as illustrated. The stop 19 should preferably have a maximum height equal to the clearance between the lug 2 and the inner edge of the hole 1 capable of contacting the lug.

Figure 8A:
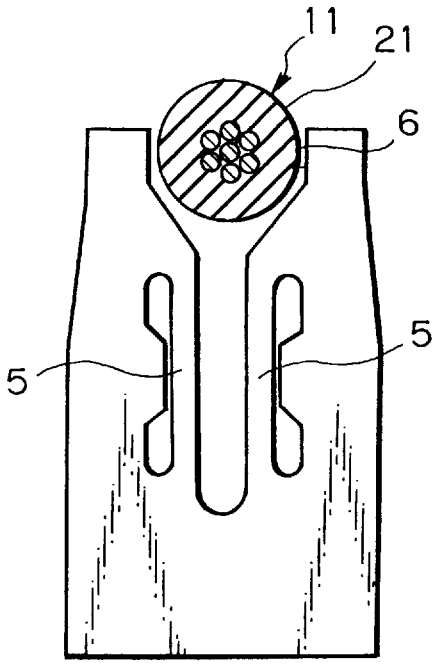
FIGS. 8A and 8B are plan views showing how a cable with a stranded core is connected by the embodiment shown in FIG. 3.
Figure 8B:
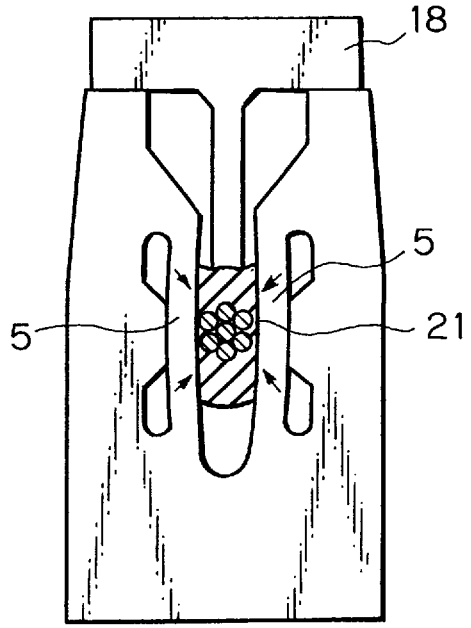

As shown in FIGS. 8A and 8B, assume that the cable 11 has a stranded core 21. As shown in FIG. 8A, the cable 11 is introduced into the inlet portion 6. Subsequently, as shown in FIG. 8B, the presser member or jig 18 pushes the cable 11 into the slit contiguous with the inlet portion 6. As a result, the cable 11 causes the beam portions 5 to bend away from each other. The beam portions 5 therefore press the stranded core 21 toward the center, as indicated by arrows. Consequently, the core 21 is prevented from breaking up.

In the embodiment and its modification, the lugs 2 each has a trapezoidal configuration. The flat end of each lug 2 is set in accordance with the diameter of the core of the cable 11. Preferably, the flat end should merge into the opposite portions of the associated edge along smooth inclination, so that the stress does not concentrate.

In summary, in accordance with the present invention, a cable connector includes beam members for retaining therebetween the core of a cable whose covering has been cut. The beam members are fixed at both ends thereof. Lugs each limit the deformation of the respective beam member. The deformation of the beam members retaining the core therebetween is increased within the elastic limit. With this configuration, the connector exerts a broad range of retaining forces and holds the core with a preselected force at all times. Therefore, the connector is applicable to a broad range of cable diameters and insures stable electrical connection over a long period of time.

Further, the beam portions are each supported at both ends thereof while the lugs each faces the intermediate portion of the associated beam portion. In this condition, the beam portions deform evenly with respect to the center of the connector and retain the core in such a manner as to surround it. This prevents the core from slipping out due to vibration or impact and obviates defective contact. In addition, stops may be provided in order to prevent the core from slipping out more positively.

Various modifications will become possible for those skilled in the art after receiving the teachings of the present disclosure without departing from the scope thereof.

What is claimed is:

1. A cable connector comprising:

a single flat metal plate;

a notch formed in said metal plate and comprising an inlet portion extending from one edge of said metal plate, and open at said one edge sufficiently wide to receive a cable consisting of a core and an insulating covering, and sequentially reduced in width for guiding said cable, a slit-like cutting portion extending from said inlet portion in one direction and having a width for cutting said covering up to said core, and a U-shaped slit having a contact portion extending from said cutting portion to terminate at an end of said U-shaped slit, for penetrating and electrically contacting said core at opposite edges of said slit;

a pair of parallel elongated holes formed in said metal plate at opposite sides of said slit and extending along said slit so as to define respective intervening beam portions between said contact portion and said elongated holes; and a pair of lugs each protruding from one of opposite edges of the respective elongated hole toward the other edge;

wherein when the cable is pushed into said notch, said respective beam portions deform to thereby cause the respective lug and the respective facing edge to abut against each other.

2. A cable connector as claimed in claim 1, wherein said elongated holes have respective outer edges and inner edges, said outer edges being furthest away from said contact portion, and wherein each of said lugs protrudes from said respective outer edges.

3. A cable connector as claimed in claim 1, further comprising a pair of stops protruding toward each other from opposite edges of said slit, for preventing the cable from slipping out of said notch.

4. A cable connector comprising:

a flat metal plate;

a notch formed in said metal plate and comprising an inlet portion extending from one edge of said metal plate, and open at said one edge sufficiently wide to receive a cable consisting of a core and an insulating covering, and sequentially reduced in width for guiding said cable, a slit-like cutting portion extending from said inlet portion in one direction and having a width for cutting said covering up to said core, and a U-shaped slit having a contact portion extending from said cutting portion to terminate at an end of said U-shaped slit, for electrically contacting said core at opposite edges of said slit;

a pair of parallel elongated holes formed in said metal plate at opposite sides of said slit and extending along said slit so as to define respective intervening beam portions between said contact portion and said elongated holes; and a pair of lugs each protruding from one of opposite edges of the respective elongated hole toward the other edge;

wherein when the cable is pushed into said notch, said respective beam portions deform to thereby cause the respective lug and the respective facing edge to abut against each other.

5. A cable connector as claimed in claim 4, wherein said elongated holes have respective outer edges and inner edges, said outer edges being furthest away from said contact portion, and wherein each of said lugs protrudes from said respective outer edges.

6. A cable connector as claimed in claim 4, further comprising a pair of stops protruding toward each other from opposite edges of said slit, for preventing the cable from slipping out of said notch.

* * * * *